US011215391B1

(12) United States Patent
Hanson et al.

(10) Patent No.: US 11,215,391 B1
(45) Date of Patent: Jan. 4, 2022

(54) STAGED ACCESS DOOR FOR A HOME APPLIANCE

(71) Applicant: Electrolux Home Products, Inc., Charlotte, NC (US)

(72) Inventors: Josh Hanson, Charlotte, NC (US); Saba Rizzi, Charlotte, NC (US); Brent Aaron Curtis, Terrell, NC (US)

(73) Assignee: Electrolux Home Products, Inc., Charlotte, NC (US)

( * ) Notice: Subject to any disclaimer, the term of this patent is extended or adjusted under 35 U.S.C. 154(b) by 0 days.

(21) Appl. No.: 17/108,692

(22) Filed: Dec. 1, 2020

(51) Int. Cl.
*F25D 23/02* (2006.01)
*E05B 65/00* (2006.01)

(52) U.S. Cl.
CPC ..... *F25D 23/028* (2013.01); *E05B 65/0042* (2013.01); *F25D 23/025* (2013.01); *E05Y 2900/31* (2013.01); *F25D 2323/024* (2013.01)

(58) Field of Classification Search
CPC .. F25D 23/025; F25D 23/04; F25D 2323/023; F25D 23/02; F25D 23/028; F25D 23/12; F25D 25/02; F25D 25/022; F25D 23/067; F25D 2325/021; F25D 25/024
See application file for complete search history.

(56) References Cited

U.S. PATENT DOCUMENTS 3,086,830 A * 4/1963 Malia ..... F25D 23/04 312/200
D642,600 S 8/2011 Kristiansen et al.
D646,308 S 10/2011 Kristiansen et al.
8,052,236 B2 * 11/2011 Kim ..... F25D 23/04 312/405.1
D692,929 S 11/2013 Seo et al.
D707,735 S 6/2014 Cho et al.
8,752,916 B2 * 6/2014 Kwon ..... F25D 23/028 312/292
8,851,589 B2 * 10/2014 Gwak ..... F25D 23/025 312/405.1
D723,595 S 3/2015 You et al.
9,046,294 B2 6/2015 Lee et al.
9,103,581 B2 * 8/2015 Babinski ..... F25D 25/025
(Continued)

FOREIGN PATENT DOCUMENTS

KR 20140104243 8/2014
KR 1020150077480 7/2015
KR 20180054538 5/2018

*Primary Examiner* — Hiwot E Tefera
(74) *Attorney, Agent, or Firm* — Pearne & Gordon LLP

(57) ABSTRACT

A refrigerator includes a cabinet housing a refrigerator compartment with a front opening and a door providing access to the refrigerator compartment. The door includes: a first section having a first lateral edge portion and a second lateral edge portion hingeably affixed to the cabinet's first lateral edge portion, a first opening extending generally a substantial area of the first section, inwardly facing vertical rails on each vertical side of the opening, and at least one pocket shelf moveably affixed between the vertical rails; and a second section hingeably affixed to the second lateral edge portion, with a second opening extending generally a substantial area of the second section, an insulated glass panel closing the second opening, a cavity defined between the first section and the second section, a peripheral wall surrounding the cavity, and at least one pocket shelf moveably affixed within the cavity on the peripheral wall.

4 Claims, 10 Drawing Sheets

(56) References Cited

U.S. PATENT DOCUMENTS

| | | | | |
|---|---|---|---|---|
| D738,941 | S | 9/2015 | Shin et al. | |
| 9,175,902 | B2 | 11/2015 | Oh et al. | |
| 9,285,155 | B2 | 3/2016 | Yoo et al. | |
| 9,410,732 | B2 | 8/2016 | Choi et al. | |
| 9,518,777 | B2 | 12/2016 | Lee et al. | |
| 9,568,239 | B2 | 2/2017 | Kim et al. | |
| 9,651,295 | B2 | 5/2017 | Kim et al. | |
| 9,777,958 | B2 | 10/2017 | Choi et al. | |
| 9,810,475 | B2 | 11/2017 | Kim et al. | |
| 10,295,248 | B2 | 5/2019 | Miller et al. | |
| 10,436,499 | B2 | 10/2019 | Jung | |
| 10,539,359 | B2 * | 1/2020 | Kwon | F25D 23/025 |
| 10,568,441 | B2 | 2/2020 | Lee et al. | |
| 10,598,422 | B2 | 3/2020 | Park et al. | |
| 10,962,279 | B1 * | 3/2021 | Scalf | F25D 23/04 |
| 2010/0175414 | A1 * | 7/2010 | Kim | F25D 23/04 62/377 |
| 2010/0176702 | A1 * | 7/2010 | Kim | F25D 23/04 312/405.1 |
| 2014/0062283 | A1 * | 3/2014 | Baldo | F25D 23/028 312/405.1 |
| 2014/0360220 | A1 * | 12/2014 | Rackley | F25D 23/04 62/377 |
| 2015/0233629 | A1 * | 8/2015 | Choi | F25D 23/028 312/404 |
| 2016/0138855 | A1 * | 5/2016 | Choo | E05B 1/0038 312/405.1 |
| 2016/0258670 | A1 | 9/2016 | Deka et al. | |
| 2017/0176086 | A1 | 6/2017 | Kang | |
| 2017/0191740 | A1 * | 7/2017 | Jung | F25D 23/025 |
| 2017/0211874 | A1 * | 7/2017 | Kim | F25D 23/025 |
| 2017/0219275 | A1 | 8/2017 | Suh et al. | |
| 2017/0284729 | A1 * | 10/2017 | Lim | F25D 23/04 |
| 2018/0164022 | A1 | 6/2018 | Ding et al. | |
| 2018/0187953 | A1 | 7/2018 | Lv et al. | |
| 2018/0347893 | A1 * | 12/2018 | Karl | F25D 23/04 |
| 2019/0031001 | A1 | 1/2019 | Guempel | |
| 2019/0366074 | A1 | 12/2019 | Carlton et al. | |
| 2020/0208902 | A1 * | 7/2020 | Yu | F25D 23/028 |

* cited by examiner

STAGED ACCESS DOOR FOR A HOME APPLIANCE

FIELD OF THE INVENTION

The instant invention is directed to a staged access door for a home appliance, such as a refrigerator.

BACKGROUND OF THE INVENTION

Conventional refrigeration appliances, such as domestic refrigerators, typically have both a fresh food compartment and a freezer compartment or section. The fresh food compartment is where food items such as fruits, vegetables, and beverages are stored. The freezer compartment is where food items that are to be kept in a frozen condition are stored. The refrigerators are provided with refrigeration systems that maintains the fresh food compartment at temperatures above 0° C., such as between 0.25° C. and 4.5° C. and the freezer compartments at temperatures below 0° C., such as between 0° C. and −20° C.

The arrangements of the fresh food and freezer compartments with respect to one another in such refrigerators vary. For example, in some cases, the freezer compartment is located above the fresh food compartment and in other cases the freezer compartment is located below the fresh food compartment. Additionally, many modern refrigerators have their freezer compartments and fresh food compartments arranged in a side-by-side relationship. Whatever arrangement of the freezer compartment and the fresh food compartment is employed, typically, separate access doors are provided for the compartments so that either compartment can be accessed without exposing the other compartment to the ambient air.

The access door to the compartments, for example the refrigerator compartment, is a feature that can enhance the marketability of the appliance. For example, being able to view the content of the compartment without opening the door, may be a desirable feature. Also, adding storage to the door may also be a desirable feature. Additionally, the ability to vary the configuration of the door may be desirable. Or providing an accessible storage space within the door, that may be accessed without opening the door, could also be desirable. Accordingly, there is a need for new access doors for home appliances.

SUMMARY OF THE INVENTION

A refrigerator includes: a cabinet housing a refrigerator compartment and having a front opening; and a door providing access to the refrigerator compartment moves between a closed position where the opening is closed and an open position where the refrigerator compartment is accessible. The door includes: a first section having a first lateral edge portion and a second lateral edge portion, being hingeably affixed to the cabinet along the first lateral edge portion, with a first opening extending generally a substantial area of the first section, inwardly facing vertical rails on each vertical side of the opening, and at least one pocket shelf moveably affixed between the vertical rails; and a second section hingeably affixed to the second lateral edge portion of the first section, with a second opening extending generally a substantial area of the second section, an insulated glass panel closing the second opening, a cavity defined between the first section and the second section, a peripheral wall surrounding the cavity, and at least one pocket shelf moveably affixed within the cavity on the peripheral wall. The cavity between the first section and the second section is accessed by moving the second section to an open position.

DESCRIPTION OF THE DRAWINGS

For the purpose of illustrating the invention, there is shown in the drawings a form that is presently preferred; it being understood, however, that this invention is not limited to the precise arrangements and instrumentalities and scale shown.

DESCRIPTION OF THE INVENTION

Figure 1:
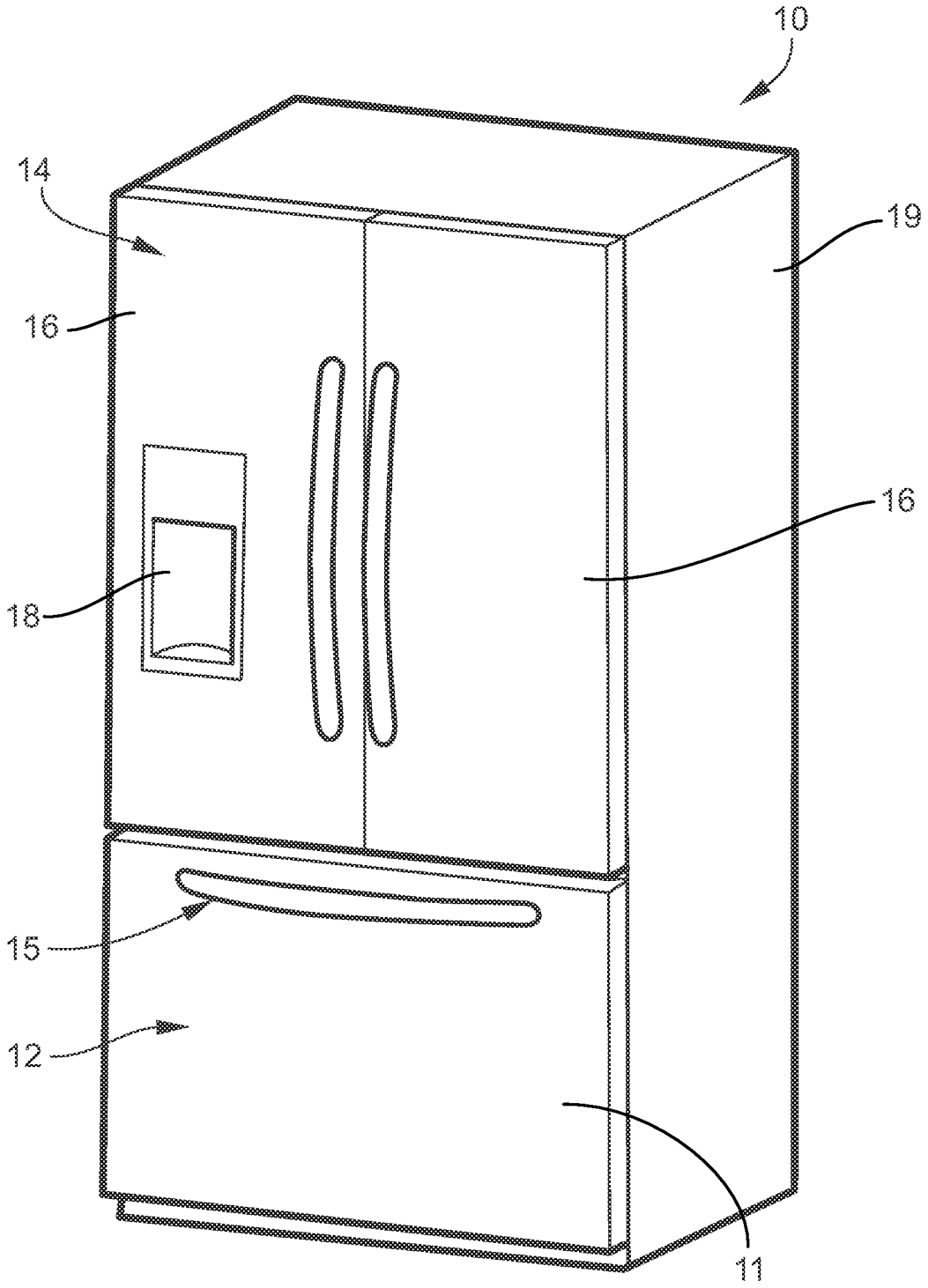
FIG. 1 is a front perspective view of a prior art household French door bottom mount refrigeration appliance showing doors of the fresh food compartment and drawer of a freezer compartment in a closed position.

Embodiments of a refrigerator or a component thereof now will be described with reference to the accompanying drawings. Whenever possible, the same reference numerals are used throughout the drawings to refer to the same or like parts.

Figure 2:
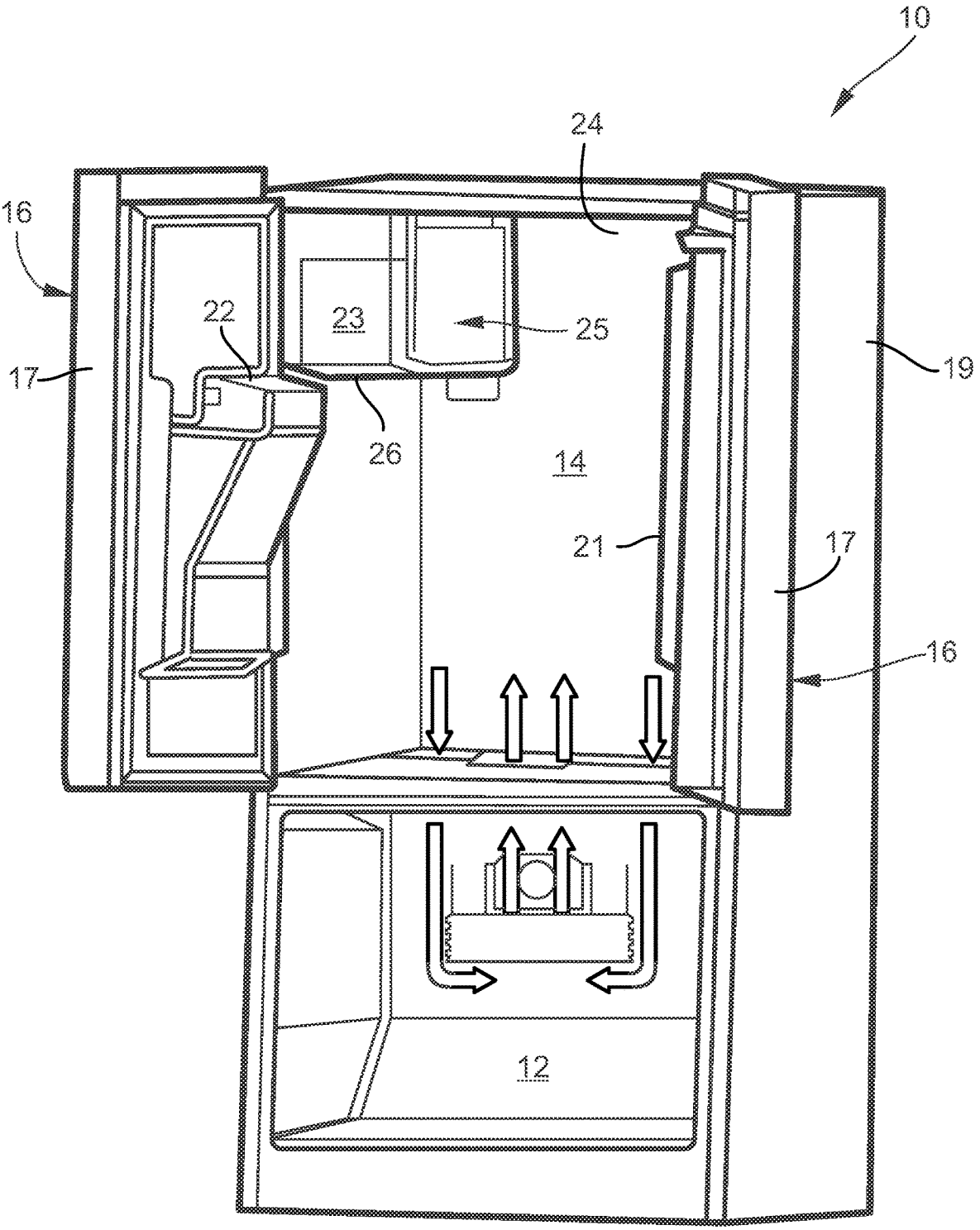
FIG. 2 is a front perspective view of the prior art refrigeration appliance of FIG. 1 showing the doors of the fresh food compartment in opened positions and the drawer of the freezer compartment removed.

Referring now to the drawings, FIGS. 1 and 2 show a refrigeration appliance in the form of a domestic refrigerator, indicated generally at 10. Although the detailed description that follows concerns a domestic refrigerator 10, the invention can be embodied by refrigeration appliances other than a domestic refrigerator 10. An embodiment is described in detail below, and shown in the figures as a bottom-mount configuration of a refrigerator 10, including a fresh food compartment 14 disposed vertically above a freezer compartment 12. However, the refrigerator 10 can have any desired configuration including at least a fresh food compartment 14 and/or a freezer compartment 12, such as a top mount refrigerator (freezer disposed above the fresh food compartment), a side-by-side refrigerator (fresh food compartment is laterally next to the freezer compartment), a standalone refrigerator or freezer, etc.

One or more doors 16 shown in FIG. 1 are pivotably coupled to a cabinet 19 of the refrigerator 10 to restrict and grant access to the fresh food compartment 14. The door 16 can include a single door that spans the entire lateral distance across the entrance to the fresh food compartment 14, or can include a pair of French-type doors 16 as shown in FIG. 1 that collectively span the entire lateral distance of the entrance to the fresh food compartment 14 to enclose the fresh food compartment 14.

For the latter configuration, a center flip mullion 21 (FIG. 2) is pivotally coupled to at least one of the doors 16 to establish a surface against which a seal provided to the other one of the doors 16 can seal the entrance to the fresh food compartment 14 at a location between opposing side surfaces 17 (FIG. 2) of the doors 16. The mullion 21 can be pivotably coupled to the door 16 to pivot between a first orientation that is substantially parallel to a planar surface of the door 16 when the door 16 is closed, and a different orientation when the door 16 is opened. The externally-exposed surface of the center mullion 21 is substantially parallel to the door 16 when the center mullion 21 is in the first orientation and forms an angle other than parallel relative to the door 16 when the center mullion 21 is in the second orientation. The seal and the externally exposed surface of the mullion 21 cooperate approximately midway between the lateral sides of the fresh food compartment 14.

A dispenser 18 (FIG. 1) for dispensing at least ice pieces, and optionally water, can be provided on an exterior of one of the doors 16 that restricts access to the fresh food compartment 14. The dispenser 18 includes an actuator (e.g., lever, switch, proximity sensor, etc.) to cause frozen ice pieces to be dispensed from an ice bin 23 (FIG. 2) of an ice maker 25 disposed within the fresh food compartment 14. Ice pieces from the ice bin 23 can exit the ice bin 23 through an aperture 26 and be delivered to the dispenser 18 via an ice chute 22 (FIG. 2), which extends at least partially through the door 16 between the dispenser 18 and the ice bin 23.

The freezer compartment 12 is arranged vertically beneath the fresh food compartment 14. A drawer assembly (not shown) including one or more freezer baskets (not shown) can be withdrawn from the freezer compartment 12 to grant a user access to food items stored in the freezer compartment 12. The drawer assembly can be coupled to a freezer door 11 that includes a handle 15. When a user grasps the handle 15 and pulls the freezer door 11 open, at least one or more of the freezer baskets is caused to be at least partially withdrawn from the freezer compartment 12.

In alternative embodiments, the ice maker is located within the freezer compartment. In this configuration, although still disposed within the freezer compartment, at least the ice maker (and possible an ice bin) is mounted to an interior surface of the freezer door. It is contemplated that the ice mold and ice bin can be separate elements, in which one remains within the freezer compartment and the other is on the freezer door.

The freezer compartment 12 is used to freeze and/or maintain articles of food stored in the freezer compartment 12 in a frozen condition. For this purpose, the freezer compartment 12 is in thermal communication with a freezer evaporator (not shown) that removes thermal energy from the freezer compartment 12 to maintain the temperature therein at a temperature of 0° C. or less during operation of the refrigerator 10, preferably between 0° C. and −50° C., more preferably between 0° C. and −30° C. and even more preferably between 0° C. and −20° C.

The refrigerator 10 includes an interior liner 24 (FIG. 2) that defines the fresh food compartment 14. The fresh food compartment 14 is located in the upper portion of the refrigerator 10 in this example and serves to minimize spoiling of articles of food stored therein. The fresh food compartment 14 accomplishes this aim by maintaining the temperature in the fresh food compartment 14 at a cool temperature that is typically above 0° C., so as not to freeze the articles of food in the fresh food compartment 14. It is contemplated that the cool temperature preferably is between 0° C. and 10° C., more preferably between 0° C. and 5° C. and even more preferably between 0.25° C. and 4.5° C.

According to some embodiments, cool air from which thermal energy has been removed by the freezer evaporator can also be blown into the fresh food compartment 14 to maintain the temperature therein greater than 0° C. preferably between 0° C. and 10° C., more preferably between 0° C. and 5° C. and even more preferably between 0.25° C. and 4.5° C. For alternate embodiments, a separate fresh food evaporator can optionally be dedicated to separately maintaining the temperature within the fresh food compartment 14 independent of the freezer compartment 12.

According to an embodiment, the temperature in the fresh food compartment 14 can be maintained at a cool temperature within a close tolerance of a range between 0° C. and 4.5° C., including any subranges and any individual temperatures falling with that range. For example, other embodiments can optionally maintain the cool temperature within the fresh food compartment 14 within a reasonably close tolerance of a temperature between 0.25° C. and 4° C.

Figure 3:
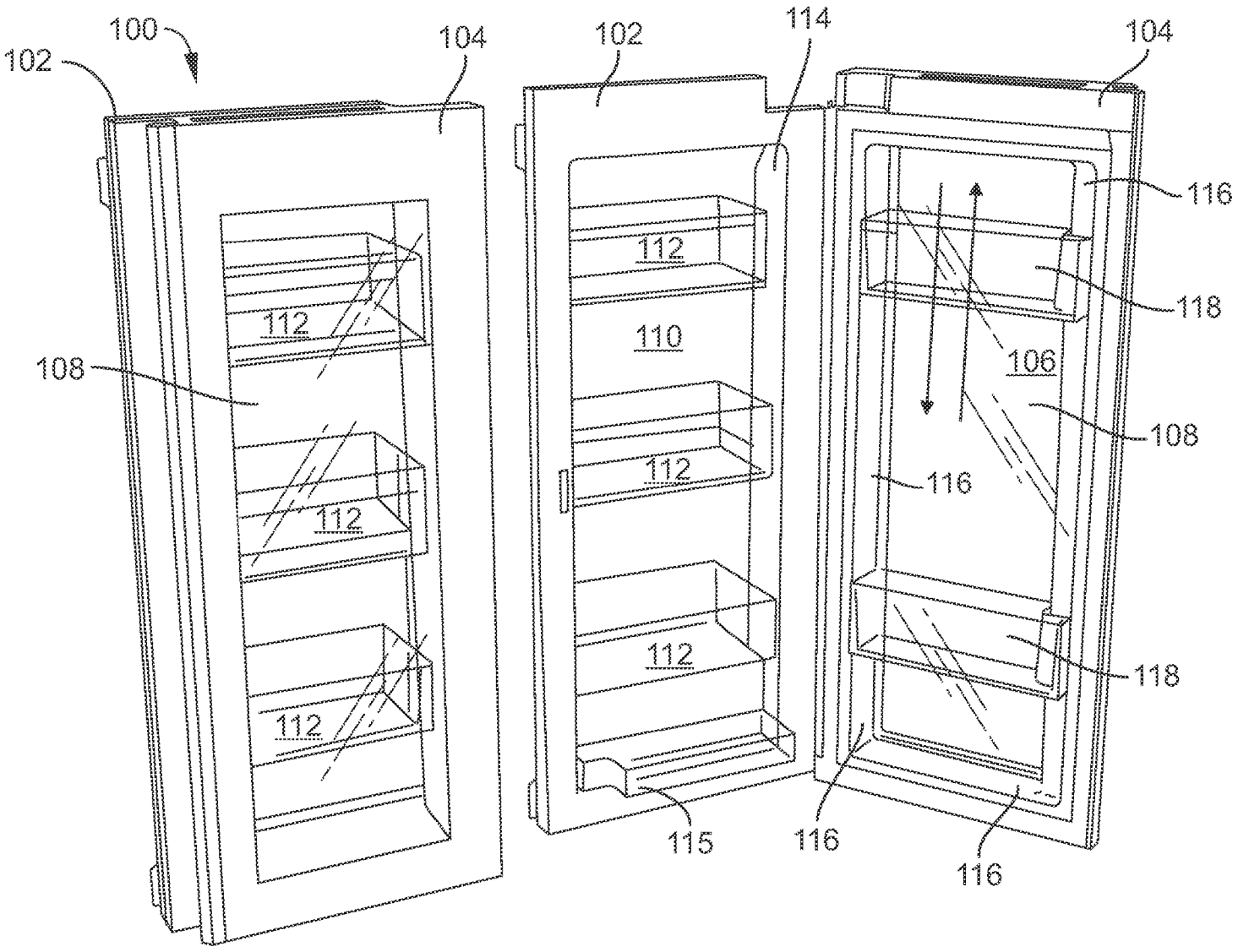
FIG. 3 is an illustration of an embodiment of the inventive door, on the left the door is shown closed and the right the door is shown open.

Referring to FIGS. 3-11, an embodiment of the staged access door will be described. In general (e.g., see FIG. 3), the stage access door 100, which is mounted on cabinet 19 (now shown) may have a first section 102 and a second section 104 with a cavity 106 therebetween with a glass panel 108 closing the cavity 106. In FIG. 3, door 100 (on the left) is in a closed position against the cabinet 19 and door 100 (on the right) is in an open position (second section 104 swung away from first section 102). The refrigerator compartment may be a fresh food compartment or a freezer compartment (as described above).

First section 102 may also include: an opening 110 that allows ingress into the compartment of the cabinet 19 (not shown in FIGS. 3-11) when the second section 104 is in the open position; at least one movable (and removable) pocket shelf (drawer/bin) 112 that are movable on (and removeable from) vertical rails 114 on lateral sides of the opening 110; and a fixed (but removable) shelf (drawer/bin) 115 that may extend into cavity 106. When the second section 104 is in the open position access to stored items on the shelves 112/115 should be possible, but only limited access to items stored in the compartment may be possible, items in the compartment are best accessed with the door 100 is an open position (e.g., both sections 102/104 are swung away from the compartment opening).

The first section 102 and the second section 104 are spaced apart to define a cavity 106. The cavity 106 is further defined by a peripheral wall 116 (in one embodiment—that wall 116 being defined by the second section 102 (shown, FIG. 3) and, in some embodiments, fixed (bottom) shelf 115. Cavity 106 provides a storage space that may be accessed when second section 104 is in the open position.

Figure 4:
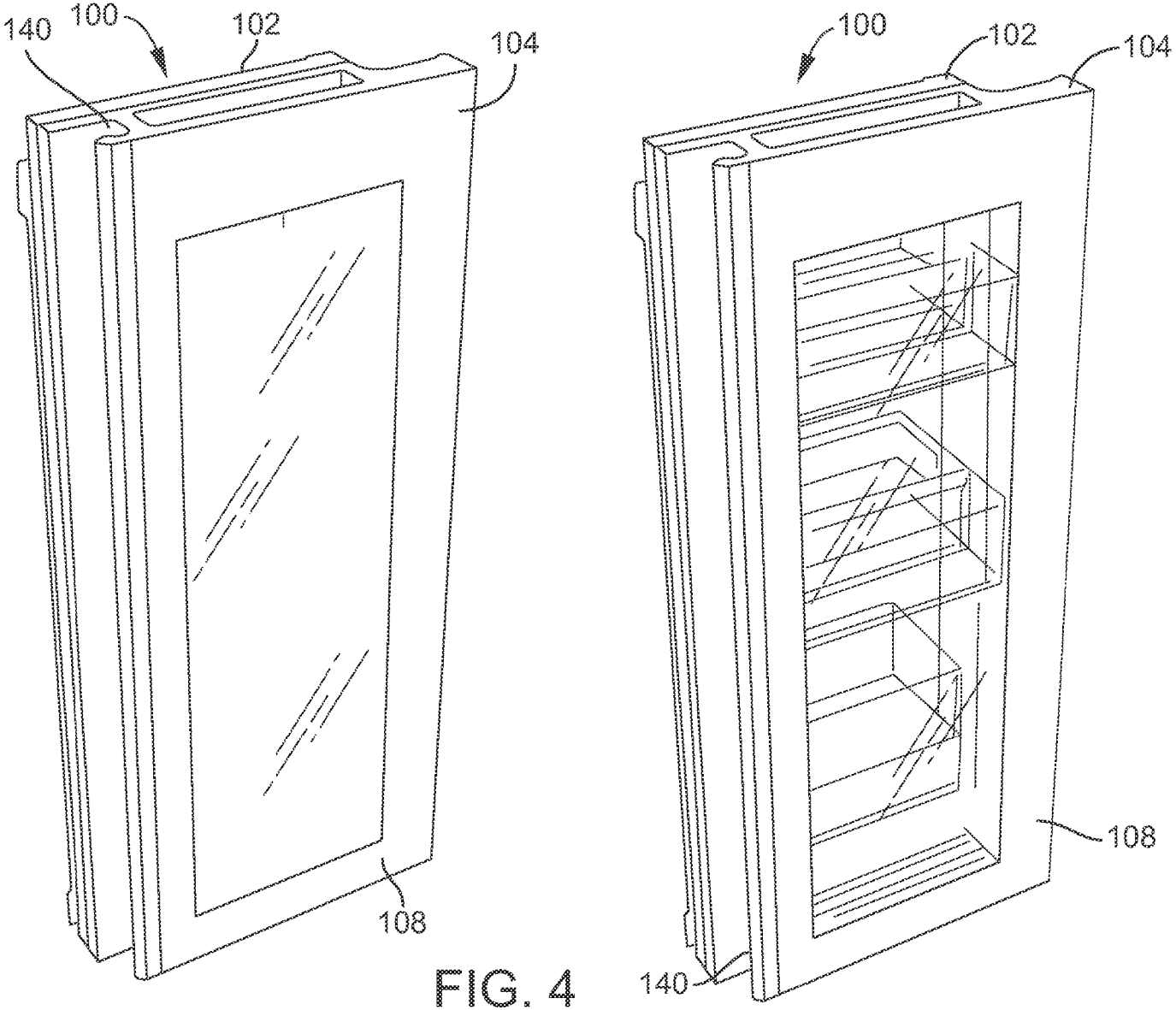
FIG. 4 is an illustration of an embodiment of the inventive door, on the left the door is shown with a dark tinted glass and the right the door is shown with a translucent tinted glass.

Second section 104 may also include: at least one moveable (and removable) pocket shelf (drawer/bin) 118 and in some embodiments (shown) may be mounted on lateral sides of the peripheral wall 116; and a pocket handle 140 (see FIG. 4). Pocket handle 140 is integral with second section 104 and on a side opposite the hinged between sections 102 and 104 and is defined by a channel, e.g. a vertical channel. When second section 104 is in the open position, items stored in the cavity 106 are accessible and, as discussed above, access to items stored on the shelves 112/115 and items in the compartment is possible.

As mentioned above, door 100 includes the first section 102 and the second section 104. First section 102 has two (first and second) lateral (vertical) edge portions. The first edge portion is hingeably connected to the cabinet. The second section 104 is hingeably connected to the second edge portion of the first section 102.

Figure 8:
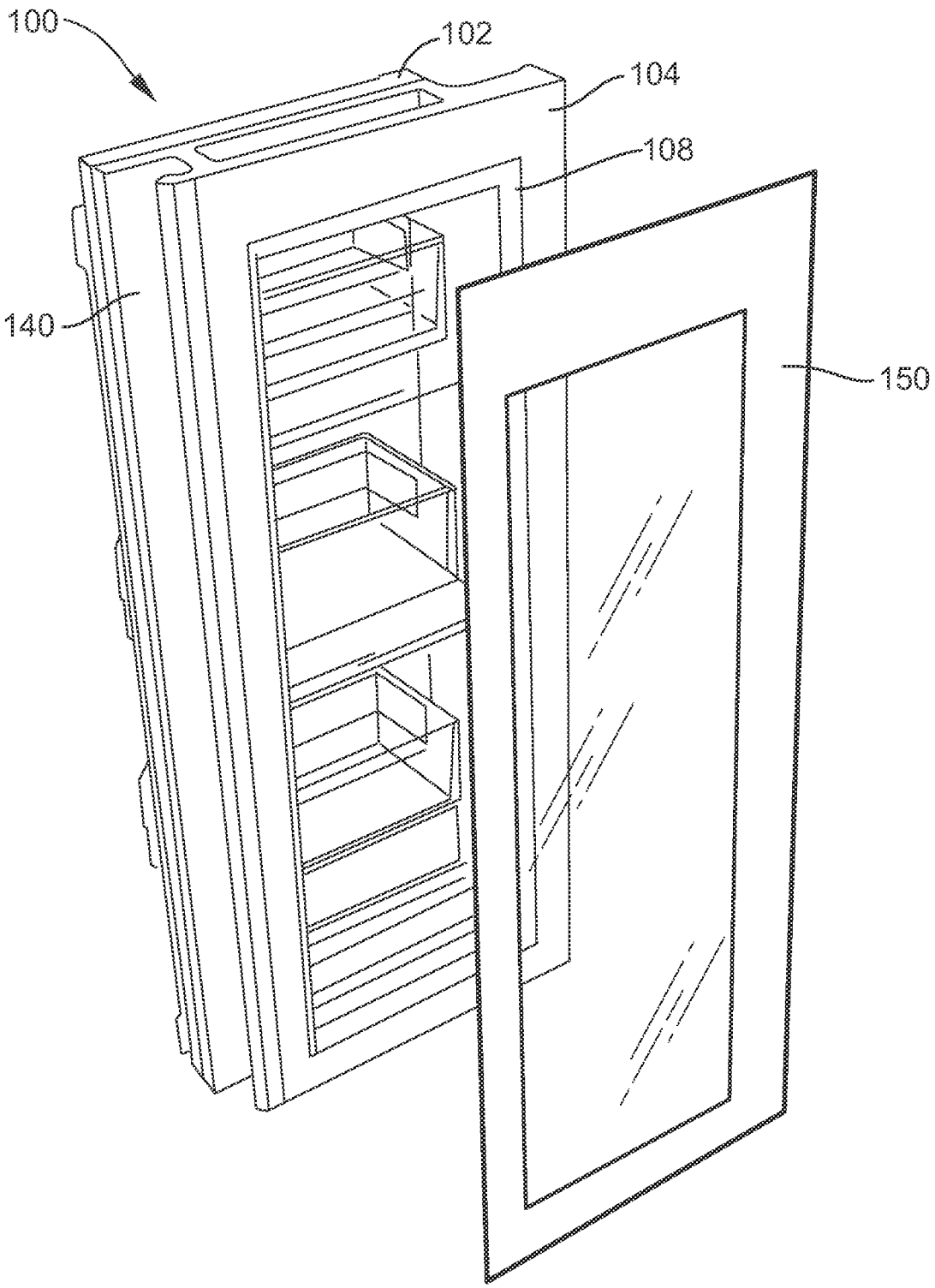
FIG. 8 is an illustration of an embodiment using a double paned vacuum glass with a tinted laminate applied to the glass.

FIGS. 4 and 8 illustrate embodiments of the glass panel 108. FIG. 4 illustrates that glass panel 108 may be tinted (and/or shaded) different colors and opacities. FIG. 8 illustrates that the glass panel may be formed with a vacuum sealed double glass unit (commercially available) and that tinting and/or shading may be obtained with laminates 130 (commercially available).

Figure 5:
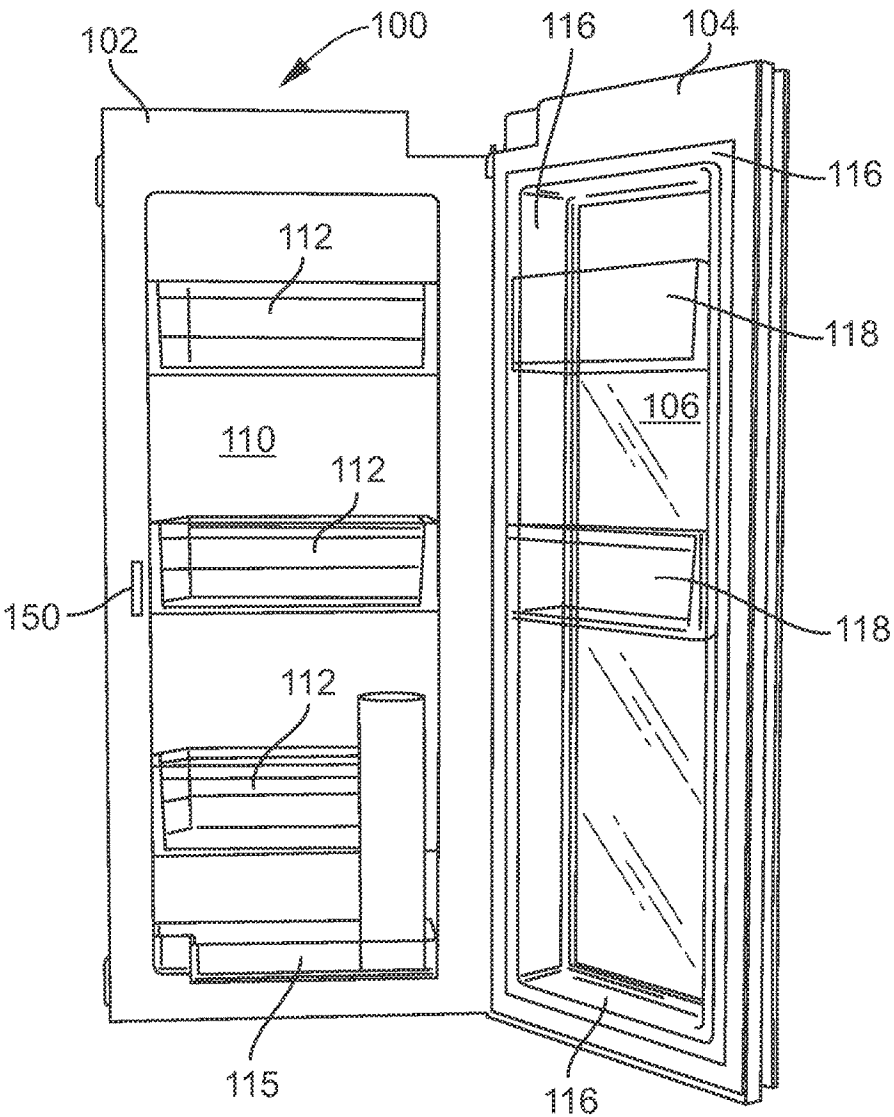
FIG. 5 is an illustration of an embodiment of the inventive door, on the left the door is shown closed with a tall object in the cavity between the first and second door sections and the right the same door is shown closed.
Figure 5:
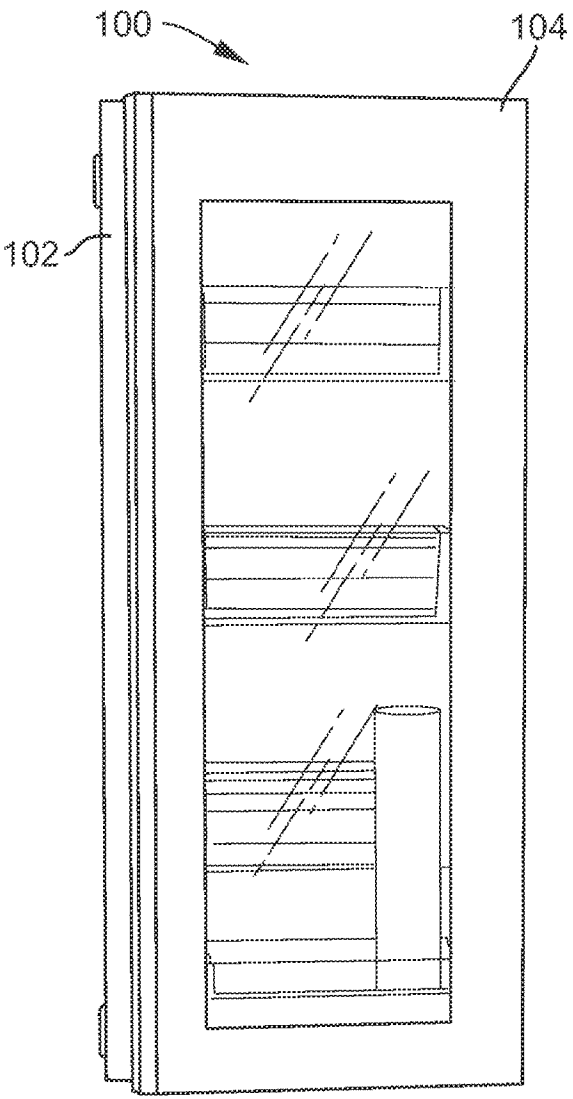
Figure 6:
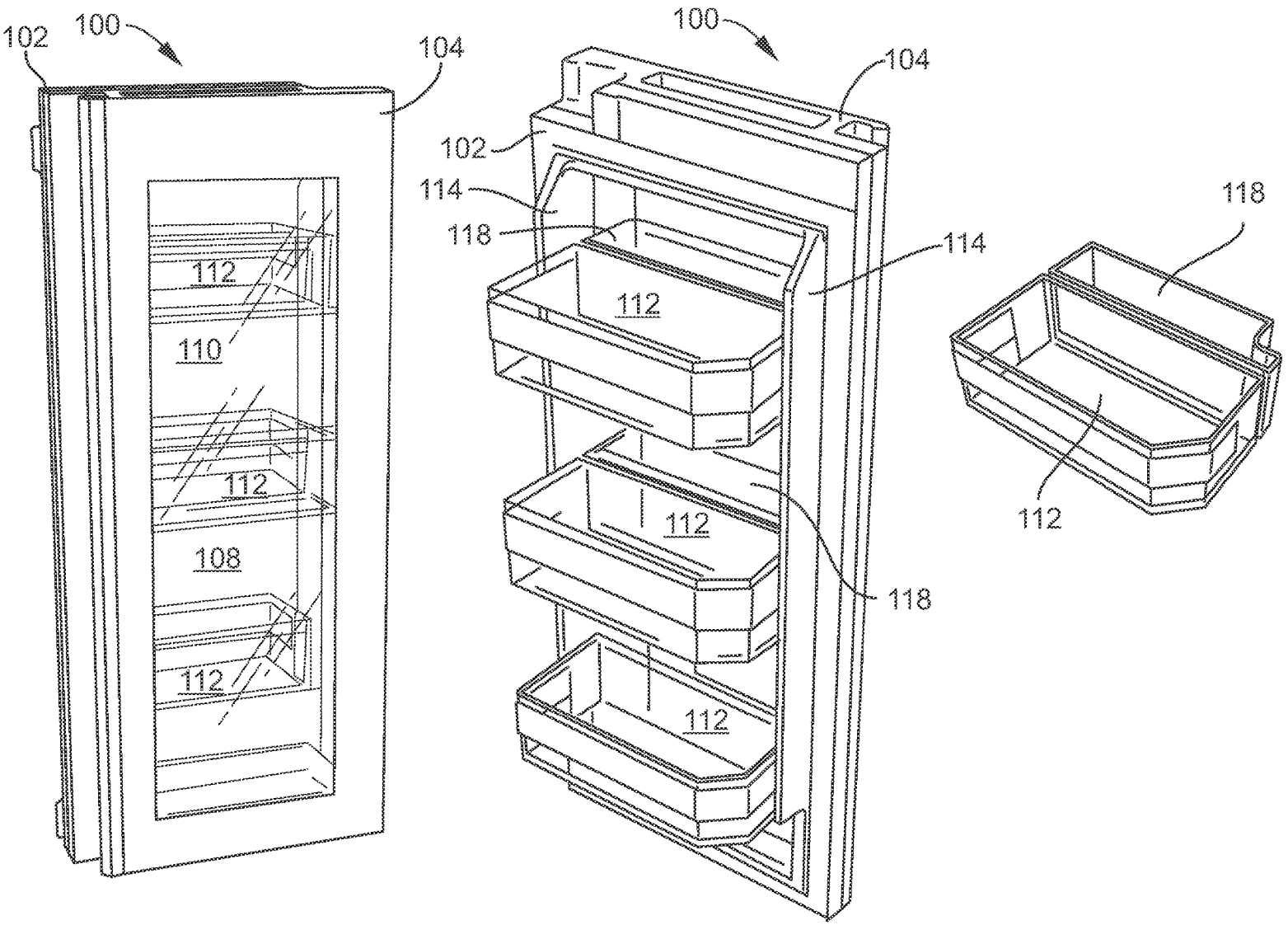
FIG. 6 is an illustration of an embodiment of the inventive door, on the left the door is shown closed and in the center the interior of the door is shown, and on the right an embodiment of a drawer for the interior of the door is shown.
Figure 7:
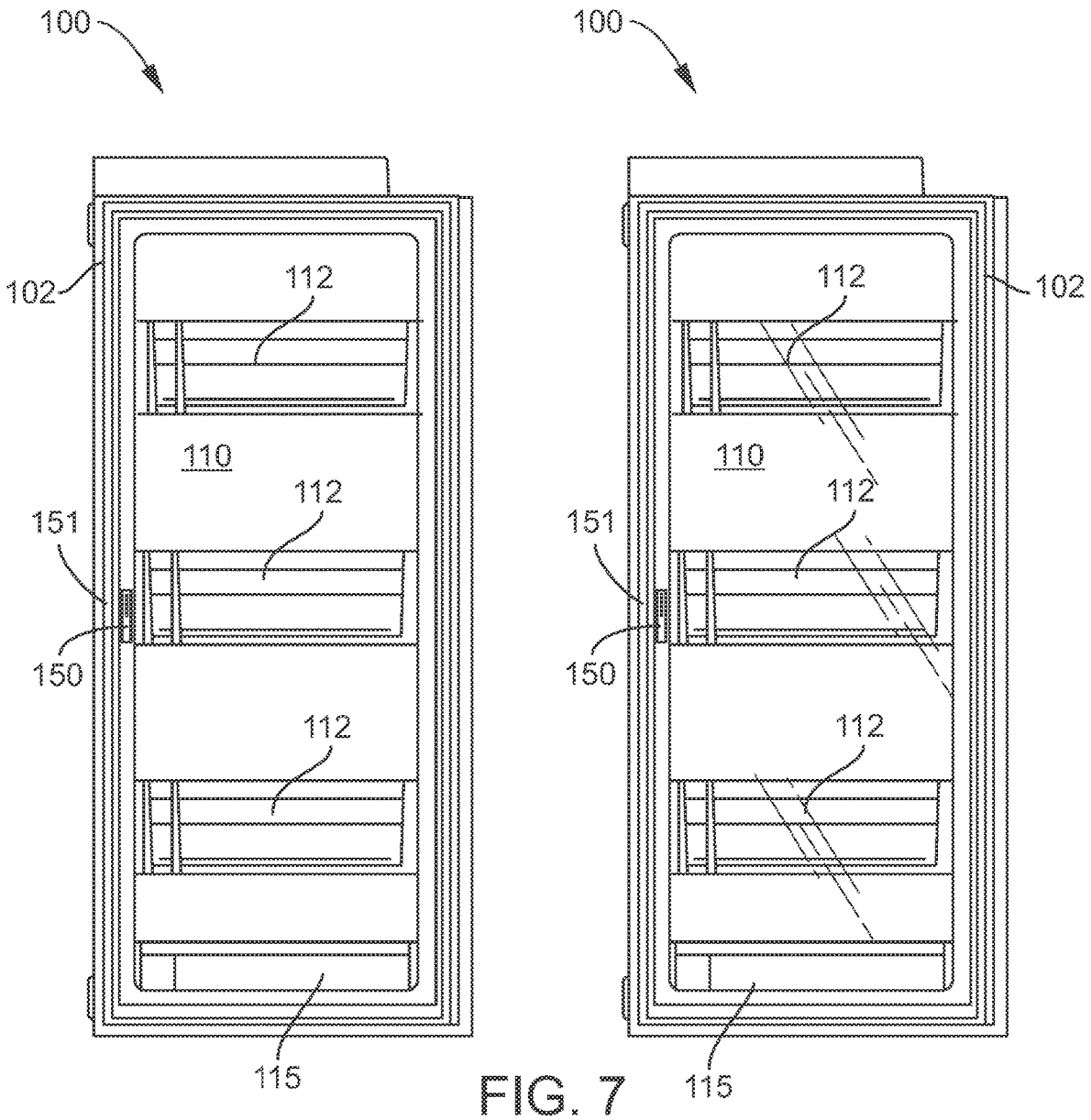
FIG. 7 is an illustration of an embodiment where an internal locking device is positioned to save space in the door.

FIG. 5 further illustrates the storage capability of cavity 106. Note the tall cylindrical item resting on shelf 115 at the bottom of cavity 106. Adjustability of the shelves 118 allows numerous storage capabilities. When shelf (bin) 112 and shelf (bin) 118 are misaligned (FIGS. 5 & 6 illustrate aligned shelves/bins), the space between shelf (bin) 112 and shelf (bin) 118 serve as a divider. When shelf (bin) 112 and shelf (bin) 118 are misaligned (FIGS. 5 & 6 illustrate aligned shelves/bins), misalignment is helpful in securing tall items on the shelf (or within the bin).

FIG. 6 further illustrates that opening 110 and glass panel 108 may define a substantial area of sections 102 and 104. 'Substantial,' as used herein, refers to at least 50% of the area and up to 95% of the area (including all subsets subsumed therein, e.g., 50-80% and the like).

Figure 9:
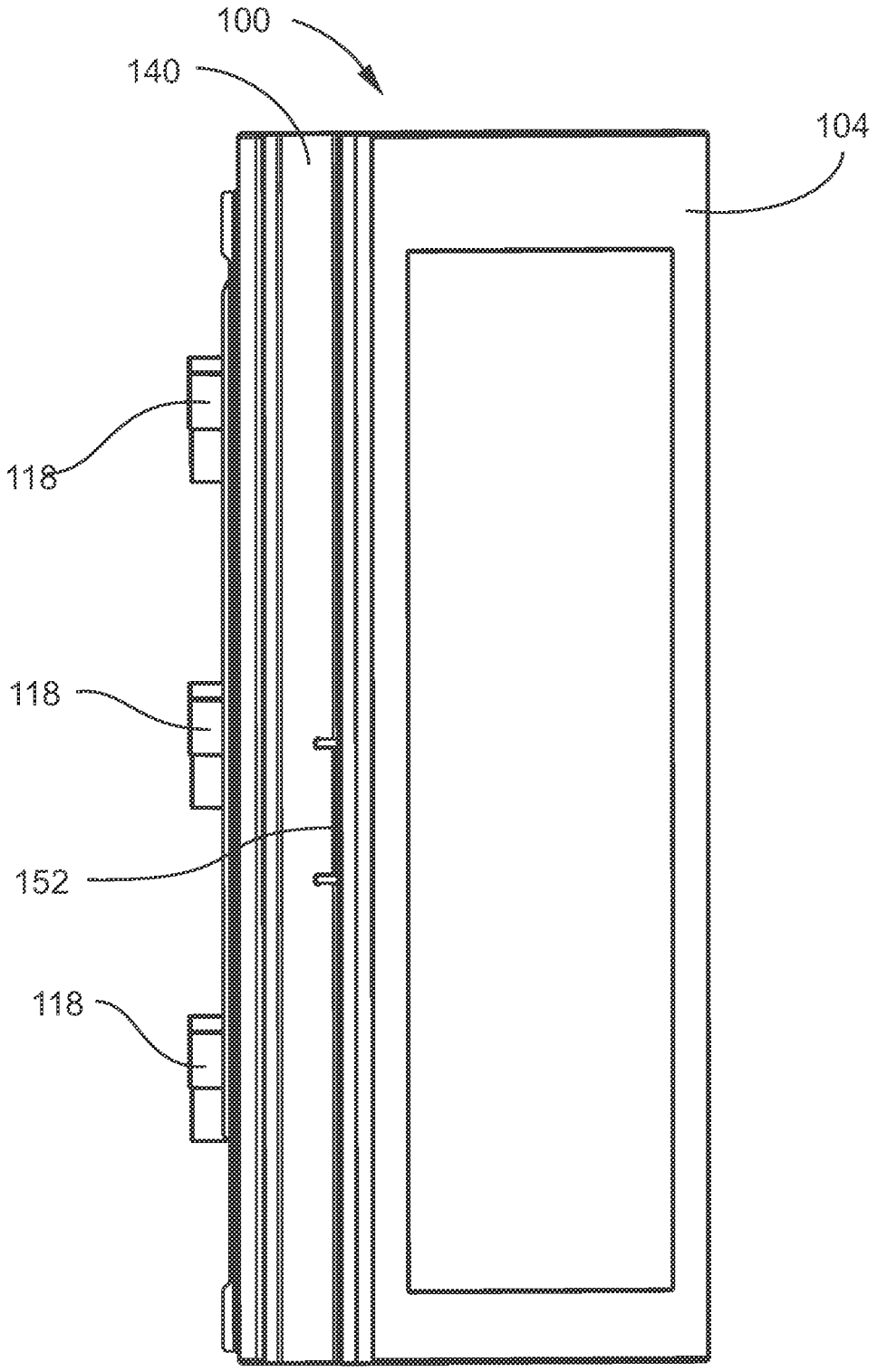
FIG. 9 is an illustration of an embodiment of a handle within a pocket in the second section.
Figure 10:
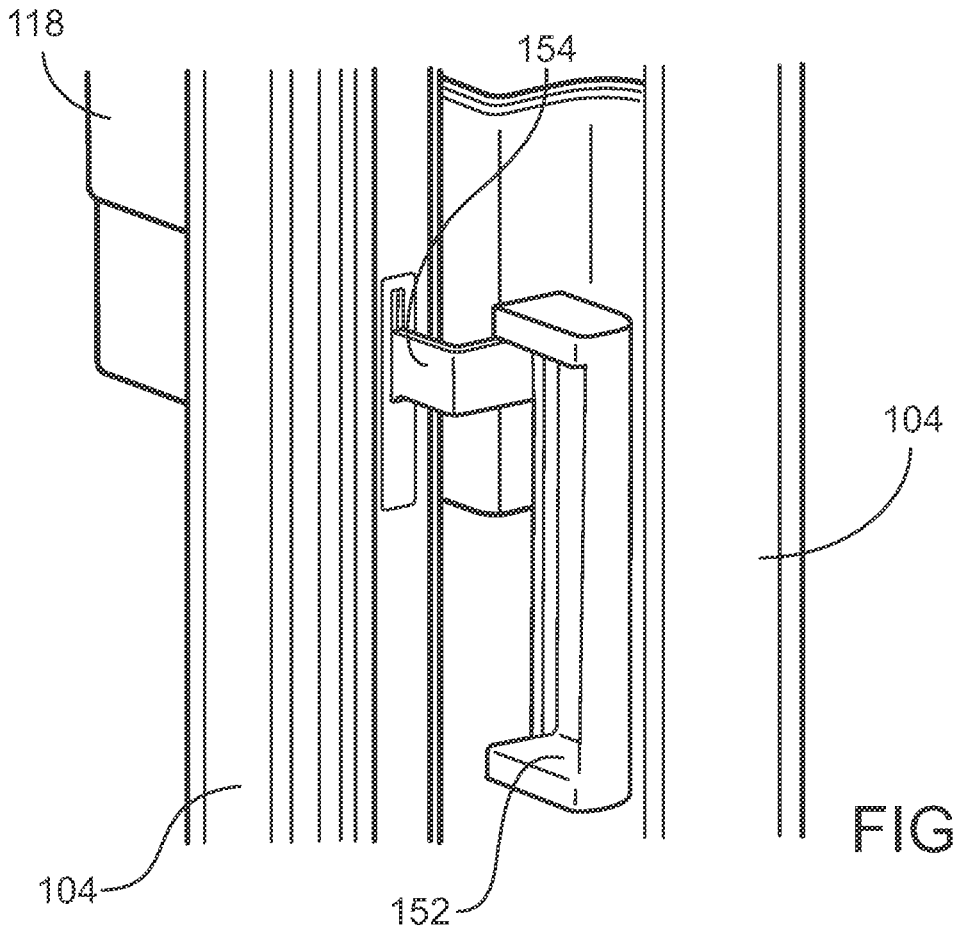
FIG. 10 is an illustration of an embodiment of a handle for a locking mechanism within a pocket in the second section.
Figure 11:
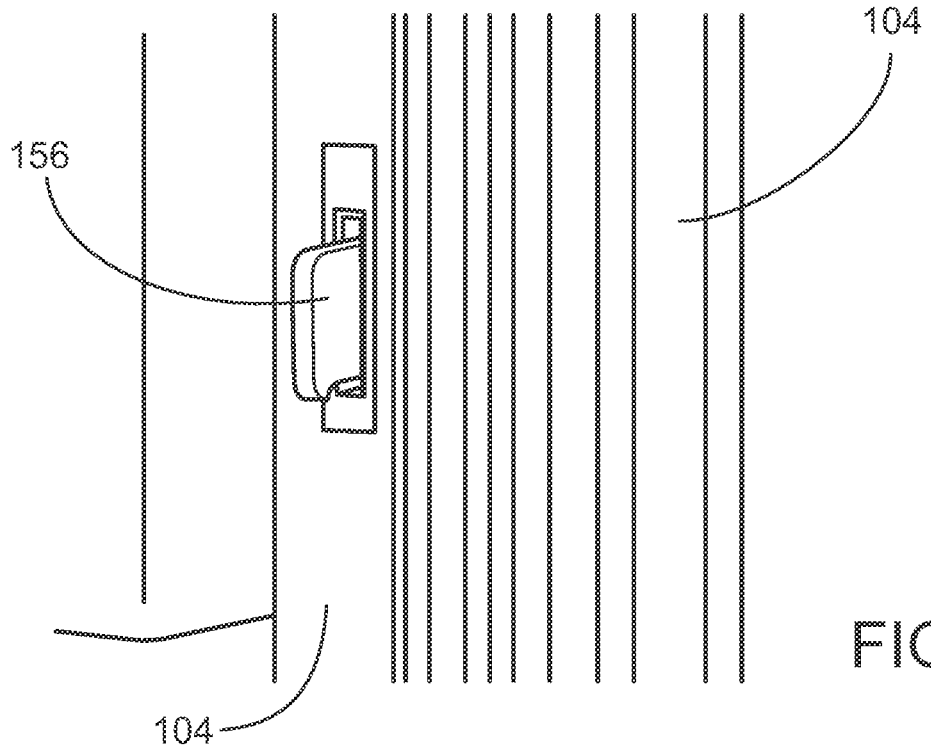
FIG. 11 is an illustration of an embodiment of the latch hook of the locking mechanism that engages the cabinet.

FIGS. 7 and 9-11 illustrate an embodiment of a locking mechanism 150 may be located within second section 104 and is used to open and close second section 104 to first section 102. FIG. 9 shows handle 152 within pocket 140. Handle 152 may be vertically slidable within the pocket 140 and is not visible outside the pocket, particularly when viewing the refrigerator from the front. FIG. 10 shows handle 152 engaging lever arm 154 and FIG. 11 shows latch hook 156 on the interior surface of section 104 that engages a mating element (not shown) on the first section 104. In this embodiment, by moving handle 154 vertically operatively connects with latch hook 156 for opening and closing of the second section 104.

The present invention may be embodied in other forms without departing from the spirit and the essential attributes thereof, and, accordingly, reference should be made to the appended claims, rather than to the foregoing specification, as indicating the scope of the invention.

We claim:

1. A refrigerator comprising:

a cabinet housing a refrigerator compartment and having a front opening; and a door providing access to the refrigerator compartment and movable between a closed position wherein the opening is closed and an open position wherein the refrigerator compartment is accessible, the door including:

a first section being hingeably affixed to the cabinet, the first section comprising:

a first opening extending generally a substantial area of the first section, inwardly facing vertical rails on each vertical side of the opening, and at least one first pocket shelf moveably affixed between the vertical rails; and a second section hingeably affixed to the first section, the second section comprising a second opening extending though a substantial area of the second section, an insulated glass panel closing the second opening wherein the second opening and the insulated glass panel define a cavity having a peripheral wall, and at least one second pocket shelf moveably affixed within the cavity on the peripheral wall, wherein the at least one first pocket shelf and the at least one second pocket shelf are configurable to align with each other when the second section of the door is in a closed position relative to the first section of the door.

2. The refrigerator of claim 1, further comprising:

a locking mechanism for holding the first section in a closed position relative to the second section.

3. The refrigerator of claim 1, further comprising:

a pocket handle incorporated in the second section at an edge portion of the second section, the pocket handle disposed on a side of the second section opposite from a hinge joining the second section to the first section.

4. The refrigerator of claim 3, further comprising:

a locking mechanism for holding the first section in a closed position relative to the second section, the locking mechanism disposed within the pocket handle and configured to move vertically within the pocket handle.

* * * * *